US006641375B2

(12) United States Patent
Liao

(10) Patent No.: US 6,641,375 B2
(45) Date of Patent: Nov. 4, 2003

(54) PNEUMATICALLY OPERATED OIL PUMP

(75) Inventor: Po-Lin Liao, Taichung (TW)

(73) Assignee: Lih Yann Co., Ltd., Taichung (TW)

( * ) Notice: Subject to any disclaimer, the term of this patent is extended or adjusted under 35 U.S.C. 154(b) by 0 days.

(21) Appl. No.: 10/115,295

(22) Filed: Apr. 3, 2002

(65) Prior Publication Data

US 2003/0190240 A1 Oct. 9, 2003

(51) Int. Cl.[7] ..... F04B 35/02

(52) U.S. Cl. ..... 417/360; 222/399; 222/383.1; 417/398; 417/399; 417/547; 417/554

(58) Field of Search ..... 222/399, 383.1; 417/360, 398, 399, 403, 547, 554

(56) References Cited

U.S. PATENT DOCUMENTS 3,827,339 A * 8/1974 Rosen et al. ..... 92/152
4,114,782 A * 9/1978 Berry ..... 222/382
4,445,819 A * 5/1984 Walling ..... 417/318
4,955,792 A * 9/1990 Skarupa ..... 417/399
5,328,339 A * 7/1994 Jong ..... 417/403
6,152,706 A * 11/2000 Lund ..... 417/399
6,212,997 B1 * 4/2001 McCollough et al. ..... 92/155
6,234,361 B1 * 5/2001 Bloom ..... 222/383.1
6,244,836 B1 * 6/2001 Jordan et al. ..... 417/399
6,257,455 B1 * 7/2001 Trepina et al. ..... 222/189.09

* cited by examiner

*Primary Examiner*—Charles G. Freay
*Assistant Examiner*—Emmanuel Sayoc

(57) ABSTRACT

A pneumatically operated oil pump comprises an outer tube for extending into an oil tank and a sucking tube moveably arranged within the outer tube. The sucking tube includes one-way valve establishing an airtight arrangement with respect to an inner wall of the outer tube. An air operated device is arranged on top of the outer tube and interconnected to the sucking tube located within the outer tube. The device includes an upper operating chamber and a lower operating chamber intercommunicated with an air pipe. The device further includes a movement reciprocally moved within the device when compressed air is introduced into the device so as to move the sucking tube reciprocally.

8 Claims, 6 Drawing Sheets

28
272
27
271
28
274
27
273
271
272
281
29

29
30
30
31
31

31
31
7
7

7
711
71
73
75
74
76
761
711
71
72
73
75
74
76

PNEUMATICALLY OPERATED OIL PUMP

BACKGROUND OF THE INVENTION

1. Field of the Invention

The present invention relates to an oil pump, and more particularly to a pneumatically operated pump with which fresh oil from tank can be easily pumped out into gearbox or other intended container while the labor and time are tremendously reduced.

2. Related Art

In general, oil serving as a lubricant is stored in a barrel tank. In time of use, a manually operated pump is used to pump out the oil from the tank for application into a gearbox or container for lubrication purposes. The conventional oil pump generally includes a vertical tube immersed into the tank and in which a piston having an one-way valve is reciprocally moved within the vertical tube so as to suck the oil into the vertical tube, and finally the oil is drained out through an outlet. This conventional oil pump has been widely adopted. However, operating the conventional oil pump is laboriously and time consuming. It is preferable to provide a robust pump so as to overcome the deficiencies of the prior art.

SUMMARY OF THE INVENTION

It is an object of this invention to provide a pneumatically operated pump so that the oil contained in the barrel tank can be quickly and easily pumped out for application.

In order to achieve the object set forth, a pneumatically operated oil pump in accordance with the present invention comprises an outer tube for extending into an oil tank and a sucking tube moveably arranged within the outer tube. The sucking tube includes one-way valve establishing an airtight arrangement with respect to an inner wall of the outer tube. An air operated device is arranged on top of the outer tube and interconnected to the sucking tube located within the outer tube. The device includes an upper operating chamber and a lower operating chamber intercommunicated with an air pipe. The device further includes a movement reciprocally moved within the device when compressed air is introduced into the device so as to move the sucking tube reciprocally.

BRIEF DESCRIPTION OF THE DRAWINGS

Other objects and further features of the present invention will be apparent from the following detailed description when read in conjunction with the accompanying drawings, in which.

DETAILED DESCRIPTION OF THE PREFERRED EMBODIMENT

Figure 1:
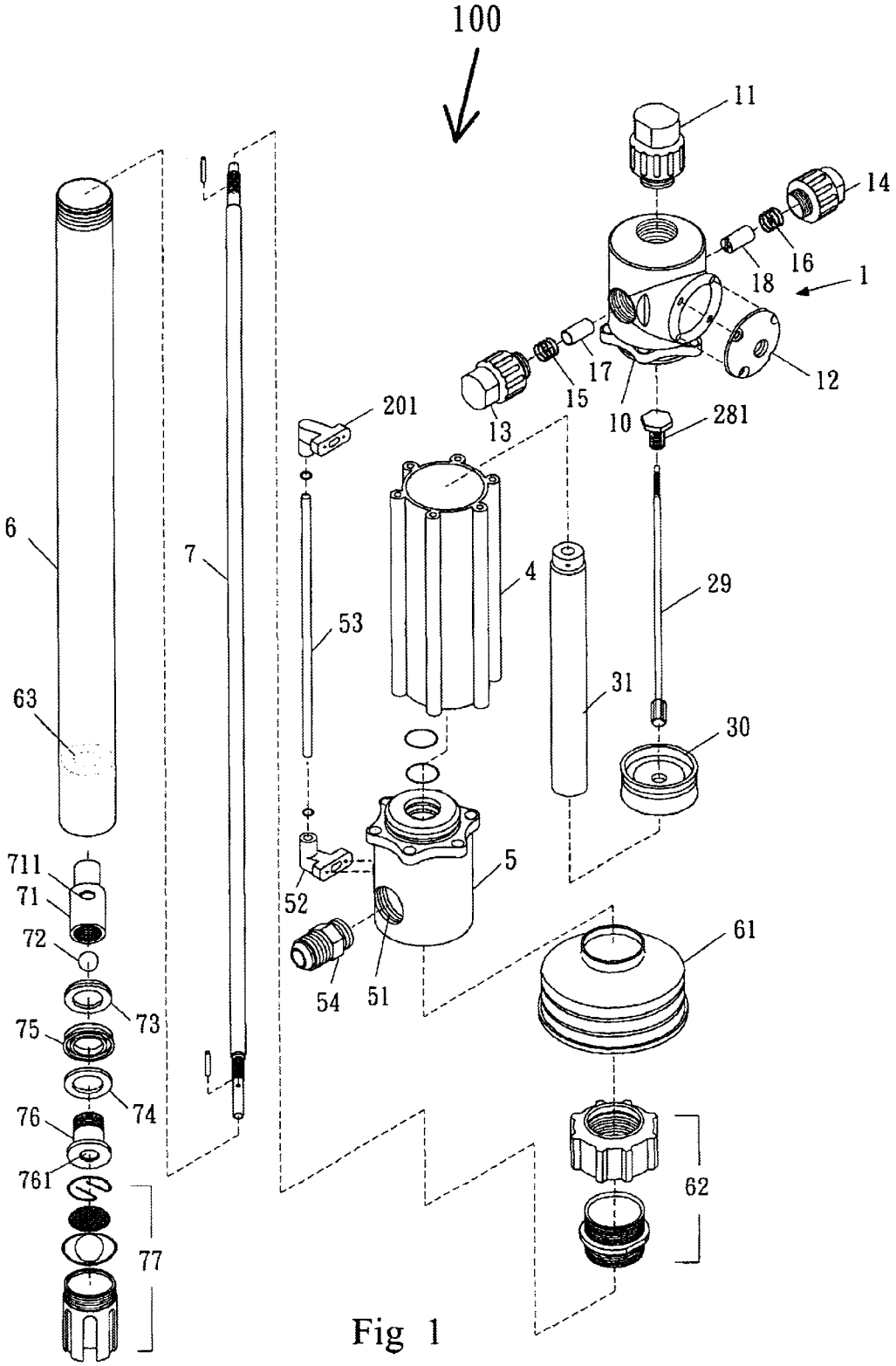
FIG. 1 is an exploded view of a pneumatically operated pump in accordance with the present invention.
Figure 1A:
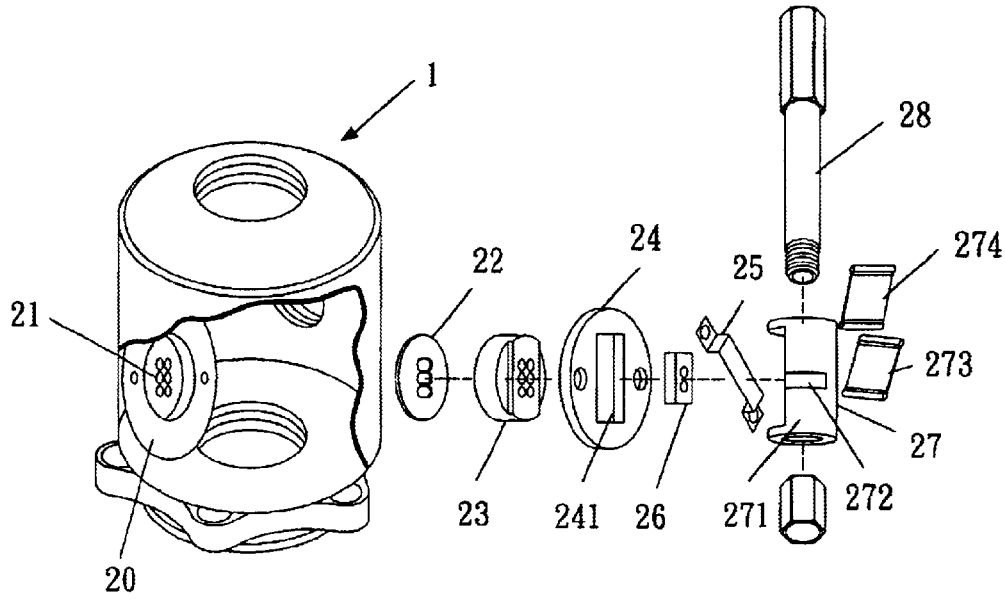
FIG. 1A is an exploded view of an operating chamber of FIG. 1.
Figure 2:
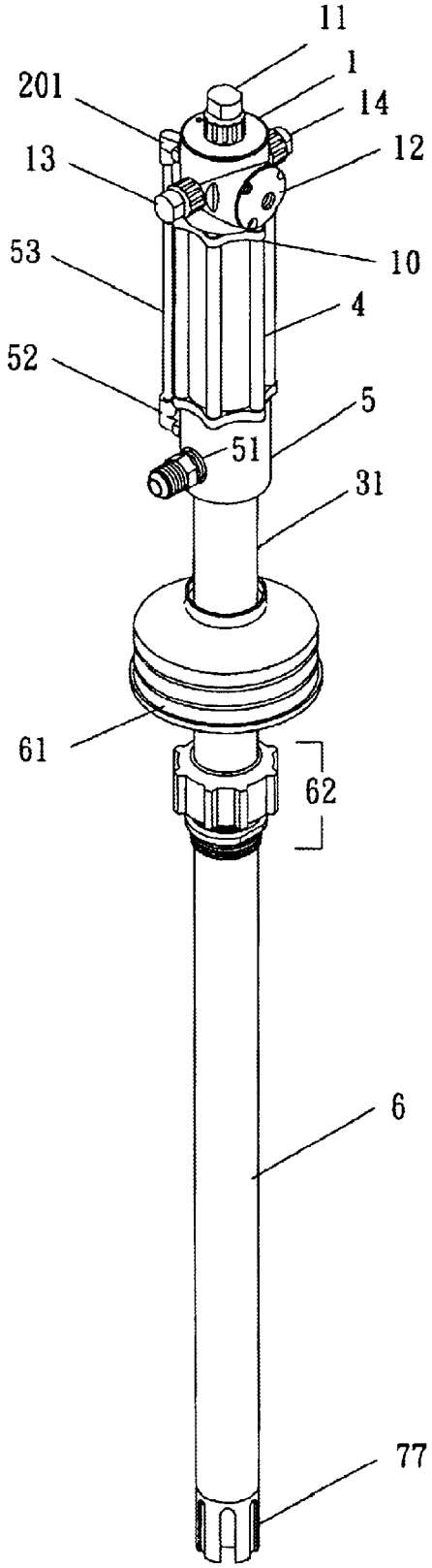
FIG. 2 is an assembled view of FIG. 1.

Referring to FIG. 1, a perspective view of a pneumatically operated pump 100 in accordance with the present invention generally comprises a cylindrical chamber 4 having an upper operating chamber 1, and a lower operating chamber 5. The pump 100 further includes an outer tube 6 and a sucking tube 7 connected to the outer tube 6. The upper operating chamber 4 is provided with a threaded hole 10 at a bottom thereof, and a cover 11 threaded to a top thereof. An inlet valve 12 is arranged on a sidewall thereof. The upper chamber 1 is further provided with a pair of adjusting bolt 13, 14 each accompanied with a coil spring 15 (16) having a pin shaft 17 (18) moveably arranged therein.

Please referring to FIGS. 2, 3A, 3B, 3C and 3D, the upper operating chamber 1 is provided with a gas exchange lid 20 having six ventilation holes 21 therein. The ventilation holes 21 are arranged in three rows. The upper operating chamber 1 further includes a converting plate 22 having three holes therein, and an aligning block 23 having six holes corresponding to the converting plate 22. The upper operating chamber 1 further includes a bracket 24 having an oblong slot 241 therein. The upper operating chamber 1 finally includes a fixing clip 25 to securely attach those element to the gas exchanging lid 20. In addition, a guiding plate 26 is moveably arranged in the oblong slot 24 of the bracket 24 which has two holes therein. The upper operating chamber 1 is further includes a cylindrical movement 27 having upper and lower rings. The movement 27 has a cutoff such that the body 271 has a semi-circular shape. The movement 27 further includes a pair of dimples 272 each receives a wing 273 (274) therein. The free end of the wing 273 (274) abuts against the pin shaft 17 (18).

An upper shaft 28 is coupled to a top of the movement 27 and which is further connected with a hollow bolt 281 which is in turn connected with an inner tube 29. The inner tube 29 extends through a pressing ring 30 and connects to a relay tube 31 which is received in the cylindrical chamber 4. The lower operating chamber 5 has a hollow configuration and defines an oil outlet 51 aside. The lower operating chamber 5 is further connected with a gas manifold 52 connected to a fist gas manifold 201 of the upper operating chamber 1 through a pipe 53.

Figure 3:
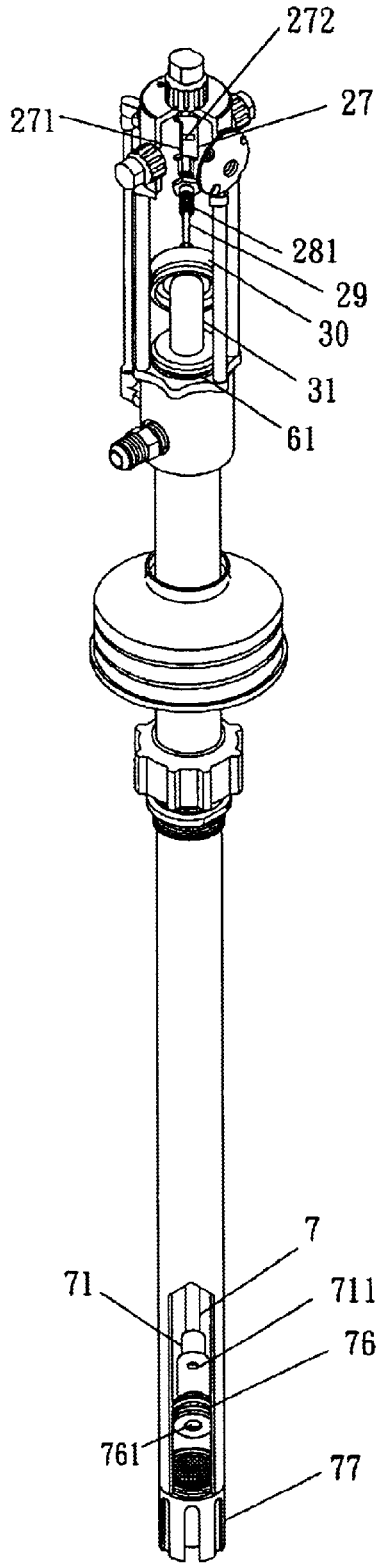
FIG. 3 is a perspective view with portion removed for illustration of inner components.
Figures 3A, 3B, 3C, 3D:
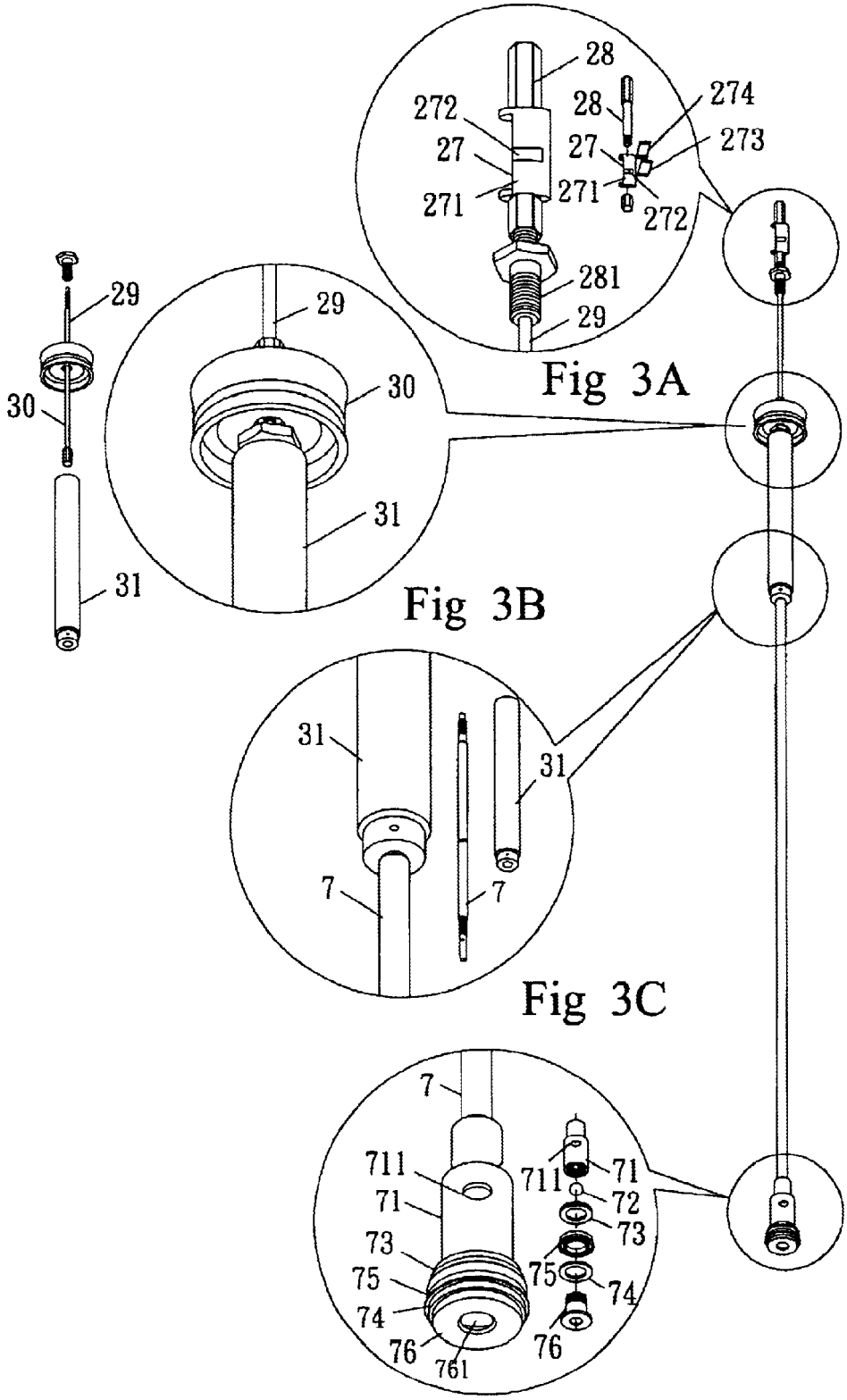
FIG. 3A is an enlarged view of the operating chamber showing specially the gas exchanging mechanism.
FIG. 3B is an enlarged view showing a relationship between an inner tube, pressure ring, and a relay tube.
FIG. 3C is an enlarged view of showing a relationship between the relay tube and a sucking tube.
FIG. 3D is an enlarged view showing end portion of the sucking tube.

The inner tube 29 is further connected with the sucking tube 7, as clearly shown in FIG. 3C. The sucking tube 7 is installed within an outer tube 6 provided with a protective cap 61 and a coupler 62 for detachably engage with an outlet of a tank. The sucking tube 7 further includes a socket 71 having an orifice 711 therein and in which a ball 72 is seated therein. A sealing 73, a washer 74, a buffer ring 75, a T-block 76 and an one-way valve 77 are assembled thereto sequentially. The ball 72 automatically seals an opening 761 defined in the T-block 76, while the buffer ring 75 of the sucking tube 7 extends through an opening 63 of the outer tube 6. In addition, the T-block 76 together with other elements provides a seal between an inner wall of the outer tube 6.

Figure 4:
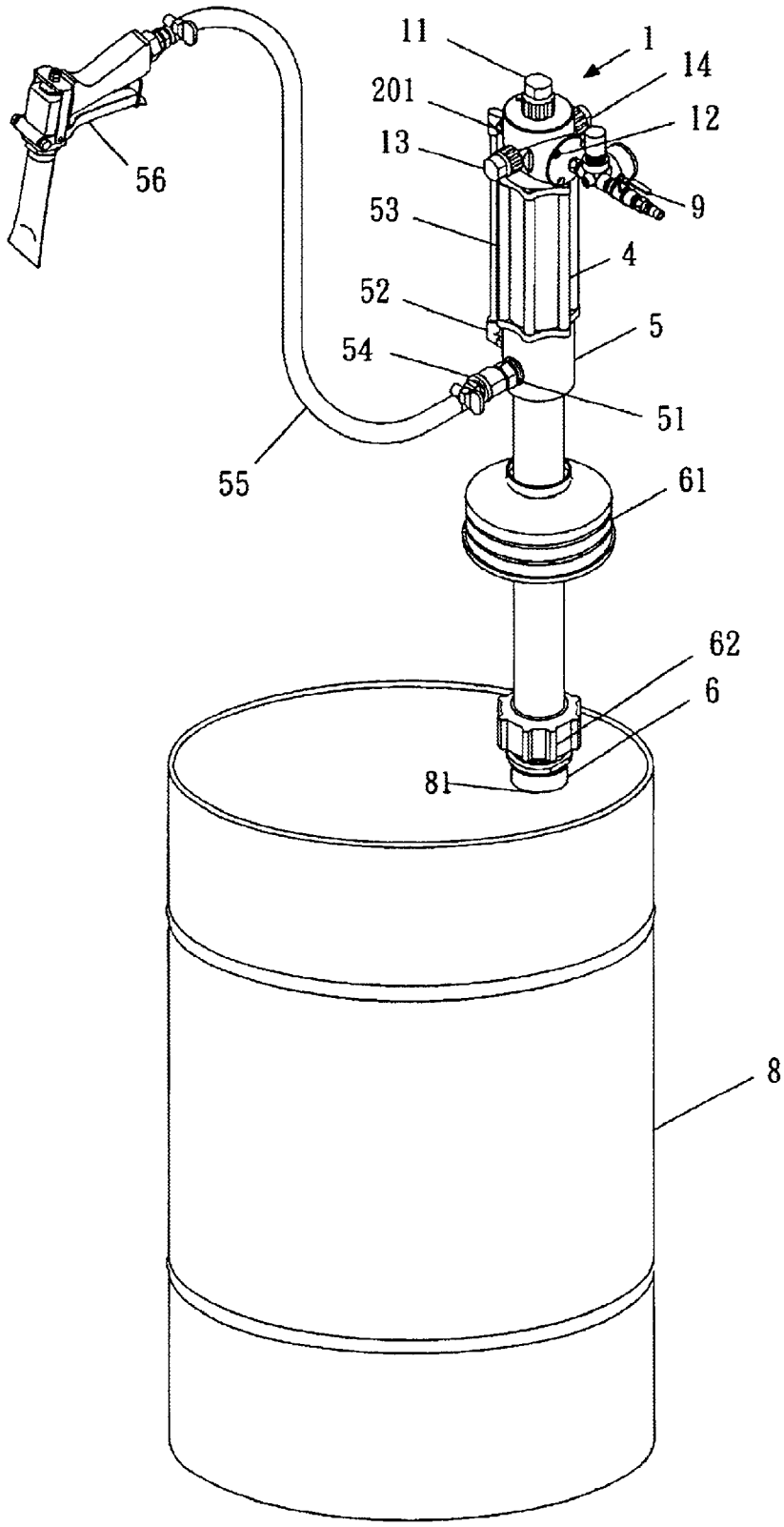
FIG. 4 is an illustration showing how the pump according to the present invention is operated.

As shown in FIG. 4, when the user wants to pump out the oil from the tank, the outer tube 6 is firstly extends into the tank 8 through an outlet 81 such that the coupler 62 sealingly engages to the outlet 81. If the coupler 62 is unable to engage with the outlet 81, the protective cap 61 can be lowered down so as to cover the outlet 81 for preventing the oil tank 8 from being contaminated by dust or other debris. The outlet 51 of the lower operating chamber 5 is further coupled with an one-way valve 54 and an oil hose 55 having an oil gun 56 at an end. The upper operating chamber 1 is further provided with a pressure adjuster 9 adjacent to inlet valve 12 and which is connected to an air compressor (not shown).

When compressed air is introduced from the adjuster 9 through the inlet valve 12 into the upper operating chamber 1, the guiding plate 26 seals those six ventilation holes 21 of the gas exchange lid 20. Accordingly, the compressed air routes to the ventilation holes 21 which are not sealed by the guiding plate 26 and finally enters the pipe 53 through the first gas manifold.201. The compressed air routes into the lower operating chamber 5 through the second gas manifold 52 so as to push the pressing ring 30 to move upwardly. As a result, the inner tube 29 and the upper shaft 28 are lifted simultaneously and ends of the wings 273, 274 of the movement 27 are also moved upward, while the other ends are still bearing with the pin shafts 17, 18. When the movement 27 keeps moving upwardly, as the ends of the wings 273, 274 are limited by the pin shaft 17, 18 such that the movement 27 changes its upward movement into a downward movement. In addition, the semi-circular body,27 blocks the compressed air during the end of the upward stroke of the movement 27. In this situation, because the limitation of the wings 273, 274, the movement 27 moves downward such that the compressed air routes a reverse direction and back to the upper operation chamber 1. In addition, the compressed air exits the system through the ventilation holes 21 of the gas exchange lid 20. This is the cycle of the compressed air and it can repeatedly cycle within the system to move the movement 27 up and down.

When the movement 27 moves upward and downward, the sucking tube 7 moves upward and downward accordingly as it immersed into the oil. As the sucking tube 7 is limited by the opening 63 of the outer tube 6, the movement 27 is also limited. When the sucking tube 7 is moved downward, the ball 72 of the sucking tube 7 is moved upward by the impulsion of the oil such that the oil enters into the outer tube 6 through orifice 711 of the socket 71 and the opening 761 of the T-block 76. When the sucking tube 7 moves upward, the ball 72 moves downward so as to seal the opening 76 of the T-block 76 so as to prevent the oil from leaking from the outer tube 6. In addition, the one-way valve 77 together with the airtight arrangement between the T-block 76 and the inner wall of the outer tube 6 keep the oil contained within the inner tube 29 without draining back to the tank. By this arrangement, the oil sucked into the outer tube 6 increases quickly and flows through the outlet 51 of the lower operating chamber 5, the one-way valve 54, the hose 55 and oil gun 56 connected to the end of the hose 55.

It will be understood that the invention may be embodied in other specific forms without departing from the spirit or central characteristics thereof. The present examples and embodiments, therefore, are to be considered in all respects as illustrative and not restrictive, and the invention is not to be limited to the details given therein.

What is claimed is:

1. A pneumatically operated oil pump, comprising:

an outer tube for extending into an oil tank;

a sucking tube moveably arranged within the outer tube, the sucking tube including a one-way valve establishing an airtight arrangement with respect to an inner wall of the outer tube; and an air operated device arranged on top of the outer tube and interconnected to the sucking tube located within the outer tube, the device including an upper operating chamber and a lower operating chamber interposed with a cylindrical chamber and intercommunicated with an air pipe, the device further including a movement reciprocally moved within the device when compressed air is introduced into the device so as to move the sucking tube reciprocally thereby pumping out oil from the tank.

2. The oil pump as recited in claim 1, wherein the pump includes a coupler adapted to be mounted on an opening of the tank.

3. The oil pump as recited in claim 1, wherein the pump includes a protective cap adapted to cover an opening of the tank.

4. The oil pump as recited in claim 1, wherein the upper operating chamber includes a gas exchange lid having ventilation holes therein, the upper operating chamber further including a converting plate having holes therein corresponding to the ventilation holes, and an aligning block having holes corresponding to the converting plate, a bracket having an oblong slot, the upper operating chamber including a fixing clip to securely attach those element to the gas exchanging lid, and a guiding plate moveably arranged in the oblong slot of the bracket 24 which has holes therein.

5. The oil pump as recited in claim 4, wherein the upper operating chamber further includes a cylindrical movement received in the cylindrical chamber and having a body with a semi-circular shape, the further includes a pair of dimples each receives a wing therein, free ends of the wing abutting against pin shaft, respectively.

6. The oil pump as recited in claim 5, wherein the movement includes an upper shaft coupled to a top of the movement and which is further connected with a hollow bolt which is in turn connected with an inner tube, the inner tube extending through a pressing ring and connects to a relay tube received in the cylindrical chamber.

7. The oil pump as recited in claim 1, wherein the lower operating chamber has a hollow configuration and defines an oil outlet therein, the lower operating chamber further including a gas manifold connected to a fist gas manifold of the upper operating chamber through the pipe.

8. The oil pump as recited in claim 1, wherein the sucking tube includes a socket having an orifice therein and in which a ball is seated therein, the socket further including a sealing, a washer, a buffer ring, a T-block and an one-way valve are assembled thereto sequentially.

* * * * *